US008935917B2

(12) United States Patent
Hayman et al.

(10) Patent No.: US 8,935,917 B2
(45) Date of Patent: Jan. 20, 2015

(54) PARTIALLY INTEGRATED EXHAUST MANIFOLD

(71) Applicant: GM Global Technology Operations LLC, Detroit, MI (US)

(72) Inventors: Alan W. Hayman, Romeo, MI (US); Rodney E. Baker, Fenton, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 124 days.

(21) Appl. No.: 13/751,791

(22) Filed: Jan. 28, 2013

(65) Prior Publication Data

US 2014/0208727 A1 Jul. 31, 2014

(51) Int. Cl.
*F01N 1/00* (2006.01)
*F01N 13/06* (2010.01)

(52) U.S. Cl.
CPC ..... *F01N 13/06* (2013.01)
USPC ..... 60/323; 60/324; 123/568.11; 123/568.12

(58) Field of Classification Search
CPC ..... F01N 13/10; F01N 13/102; F01N 13/08; F01N 13/14
USPC ..... 60/323, 324; 123/568.12, 568.11, 123/568.21, 568.2
See application file for complete search history.

(56) References Cited

U.S. PATENT DOCUMENTS 4,186,698 A * 2/1980 Aoyama ..... 123/676
4,207,738 A * 6/1980 Yoneda et al. ..... 60/278
4,284,056 A * 8/1981 Sugasawa ..... 123/568.11
5,178,119 A * 1/1993 Gale ..... 123/568.12
5,987,884 A * 11/1999 Kibe et al. ..... 60/286
6,009,709 A * 1/2000 Bailey ..... 60/605.2
6,138,650 A * 10/2000 Bailey ..... 123/568.12
6,286,489 B1 * 9/2001 Bailey ..... 123/568.11
6,425,381 B1 * 7/2002 Rammer ..... 123/568.12
7,150,273 B2 * 12/2006 Pacitti et al. ..... 123/568.2
8,561,599 B2 * 10/2013 Gingrich et al. ..... 123/568.17
2004/0168655 A1 * 9/2004 Hitomi et al. ..... 123/58.8
2006/0196178 A1 * 9/2006 Caine et al. ..... 60/324
2009/0241526 A1 10/2009 Son et al.
2009/0308070 A1 * 12/2009 Alger et al. ..... 60/602
2010/0083920 A1 4/2010 Kuhlbach
2012/0285163 A1 * 11/2012 Hayman et al. ..... 60/602
2012/0285426 A1 * 11/2012 Hayman et al. ..... 123/563
2012/0285427 A1 * 11/2012 Hayman et al. ..... 123/568.11

* cited by examiner

*Primary Examiner* — Thomas Denion
*Assistant Examiner* — Patrick Maines
(74) *Attorney, Agent, or Firm* — Harness, Dickey & Pierce, P.L.C.

(57) ABSTRACT

A partially integrated manifold assembly is disclosed which improves performance, reduces cost and provides efficient packaging of engine components. The partially integrated manifold assembly includes a first leg extending from a first port and terminating at a mounting flange for an exhaust gas control valve. Multiple additional legs (depending on the total number of cylinders) are integrally formed with the cylinder head assembly and extend from the ports of the associated cylinder and terminate at an exit port flange. These additional legs are longer than the first leg such that the exit port flange is spaced apart from the mounting flange. This configuration provides increased packaging space adjacent the first leg for any valving that may be required to control the direction and destination of exhaust flow in recirculation to an EGR valve or downstream to a catalytic converter.

20 Claims, 4 Drawing Sheets

PARTIALLY INTEGRATED EXHAUST MANIFOLD

STATEMENT OF GOVERNMENT RIGHTS

The present invention was made with government support under Cooperative Agreement No. DE-EE0005654 awarded by the Department of Energy. The Government has certain rights in the invention.

FIELD

The present disclosure relates to exhaust manifolding for a multiple-cylinder four-cycle internal combustion engine, and more particularly to a partially integrated exhaust manifold coupling an exhaust gas flow control valve with the exhaust port for one cylinder and integrating two or more exhaust runners with the exhaust ports of the remaining cylinders. The control valve selective directs the flow of exhaust gas to an exhaust gas recirculation valve or to a catalytic converter therefor bypassing the inlet system.

BACKGROUND

This section provides background information related to the present disclosure which is not necessarily prior art.

A typical automotive engine is a four-cycle internal combustion device which includes an engine block having multiple cylinders. Each cylinder supports a piston for reciprocating movement. A cylinder head is coupled to a top surface of the engine block such that the block and head define a combustion chamber. The cylinder head includes a set of intake ports and a set of exhaust ports for each cylinder which, in combination with the intake valves and exhaust valves, allow combustion gases to enter and exit the combustion chambers. An intake manifold and an exhaust manifold are typically coupled to the cylinder head for routing the combustion gases to and from the intake and exhaust ports.

It is common for a portion of the exhaust gases exiting the combustion chamber to be recirculated through an exhaust gas recirculation or EGR valve to the intake manifold or intake ports. An automotive engine may also be configured with a turbocharger having a turbine or scroll which is driven by the exhaust gases and/or may have a catalytic converter for exhaust gas treatment. As such, these components must also be in fluid communication with the exhaust ports.

It is important to locate these components as close as possible to the exhaust manifold. However, other engine components (e.g., valve train, fuel injection, air filters, alternator) and vehicle systems (e.g., transmission, power steering, front suspension, air condition compressor, etc.) must also be located adjacent the engine under the hood of the vehicle. Accordingly, the packaging space for these components can be extremely limited.

In a four-cylinder engine designed for running in dedicated exhaust gas recirculation mode, one cylinder is capable of supplying exhaust gas recirculation to all four cylinders. Thus, it may be desirable to separate the exhaust manifolding of this cylinder from the remaining three cylinders. Typically this design requires a single complex stainless steel manifold or two separate stainless steel manifolds.

SUMMARY

This section provides a general summary of the disclosure, and is not a comprehensive disclosure of its full scope or all of its features.

A partially integrated exhaust manifold can improve performance, reduce cost and efficiently package the engine components discussed above. The partially integrated exhaust manifold is adapted to be coupled directly to an engine block and includes a first leg extending from a first exhaust port and terminating at a mounting flange for a flow control valve, and at least a second leg extending from the other exhaust ports terminating at an exit port flange. The second leg is longer than the first leg such that the exit port flange is spaced apart from the mounting flange. This configuration allows for increased packaging space adjacent the first leg for any valving that may be required to control the direction/destination of the exhaust flow in recirculation to the intake side of the engine or downstream to the exhaust system including a catalytic converter.

In a four-cylinder engine configuration, the second leg may include two runners such that one runner extends from the exhaust ports for cylinder #2 and another runner extends from the exhaust port for cylinder #3. A third leg extends from the exhaust port for cylinder #4. The second and third legs may share a common exit port flange. This embodiment allows for the packaging of a single or dual turbocharger in which the turbo scrolls are driven by the exhaust gases from cylinders #2-4. In the case of a single turbocharger both legs feed the single scroll, and in the case of a dual turbocharger each leg feeds each own scroll. This embodiment also reduces "crosstalk" that may occur in a typical four-cylinder engine, thereby more evenly distributing the residual exhaust gas component for all of the cylinders.

The partially integrated exhaust manifold described and illustrated herein may be readily adapted for use in a three-cylinder configuration, wherein the first leg is paired with cylinder #1 and the second leg is paired with cylinders #2 & #3. The partially integrated exhaust manifold described and illustrated herein may also be readily adapted for use with an in-line six-cylinder configuration, wherein the first leg is paired with cylinder #1, the second leg is paired with cylinders #2 & #3, the third leg is paired with cylinders #4 & #5, and a fourth leg is paired with cylinder #6 and manifolded into the first leg.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known When an element such as a component, member or layer is referred to as being "on," "engaged to," "connected to," or "coupled to" another element, it may be directly on, engaged, connected or coupled to the other element, or intervening elements may be present. In contrast, when an element is referred to as being "directly on," "directly engaged to," "directly connected to," or "directly coupled to" another element, there may be no intervening elements present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Terms such as first, second, third, etc. may be used herein only to distinguish one element from another. These terms or other similar numerical terms when used herein do not imply a sequence or order unless clearly indicated by the context. Thus, a first element, component, region, layer or section discussed below could be termed a second element, component, region, layer or section without departing from the teachings of the example embodiments. Likewise, spatially relative terms, such as "inner," "outer," "beneath," "below," "lower," "above," "upper," and the like, may be used herein for ease of description to describe the relationship of one element relative to another as illustrated in the figures. These spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 1:
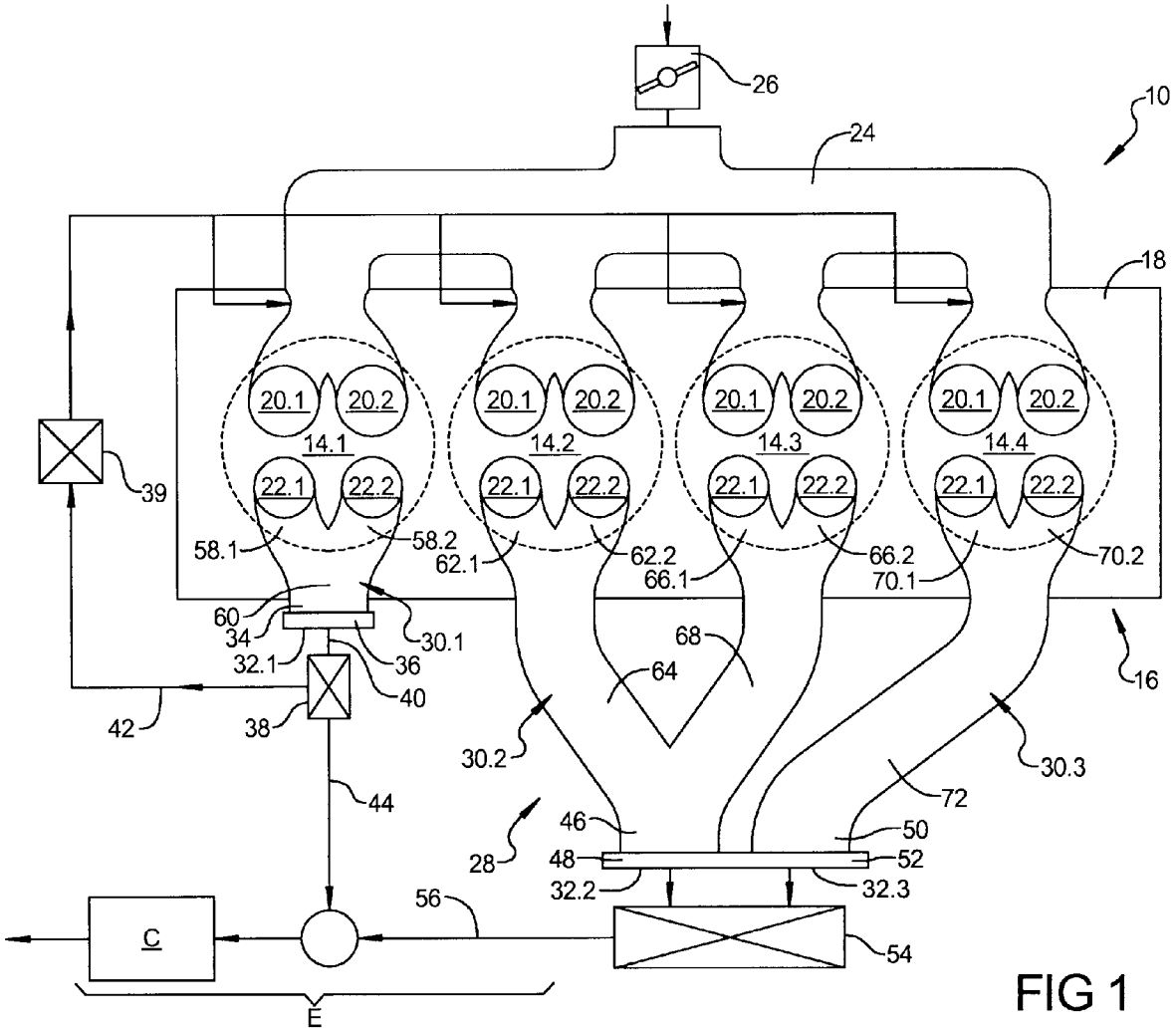
FIG. 1 is a schematic top view of a four-cylinder internal combustion engine having a partially integrated exhaust manifold.
Figure 2:
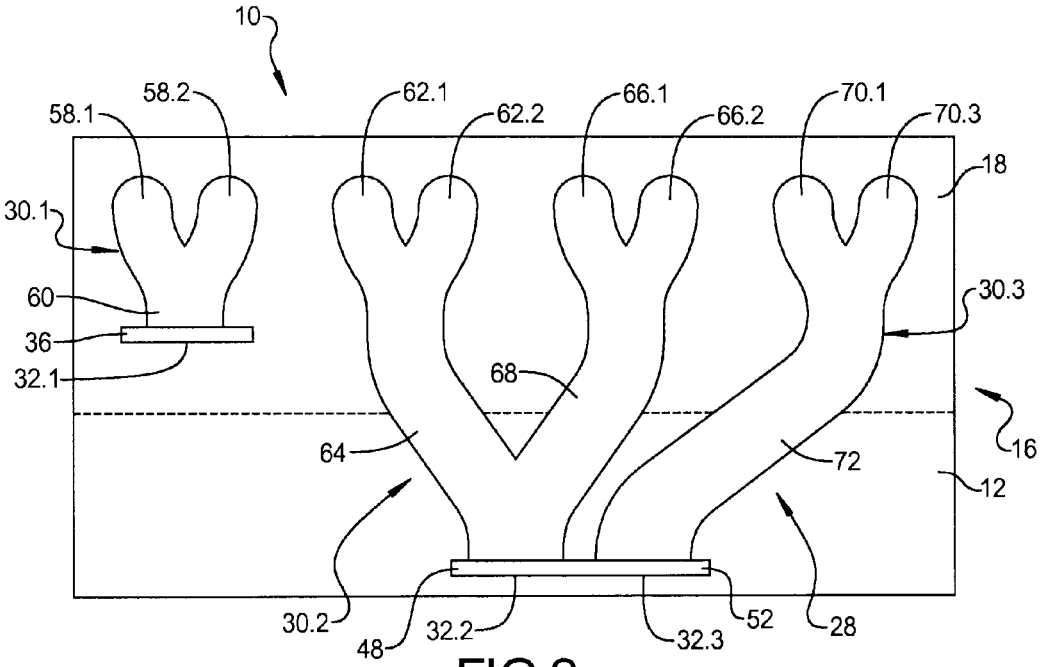
FIG. 2 is a schematic side view of the partially integrated exhaust manifold shown in FIG. 1.
Figure 3:
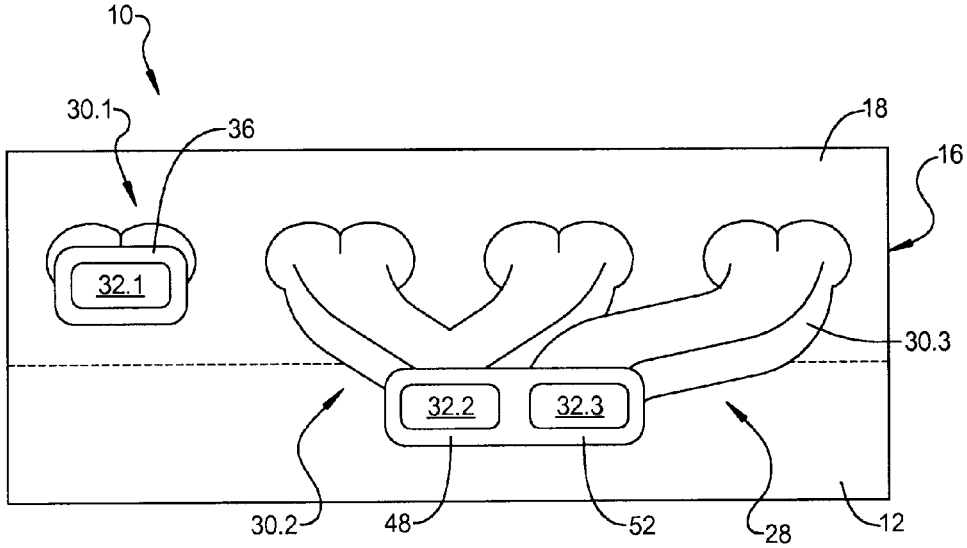
FIG. 3 is a schematic perspective view of the partially integrated exhaust manifold shown in FIG. 1.

Referring now to FIGS. 1-3, wherein like numerals indicate like parts throughout the several views, a portion of a multiple-cylinder internal combustion engine 10 is schematically represented. Engine 10 includes an engine block 12 having a plurality of cylinders 14 formed therein, a cylinder head assembly 16 coupled to the top of the engine block 12 over the cylinders 14. A body portion 18 of the cylinder head assembly 16 is coupled to the engine block 12 and has a set of intake ports 20 and a set of exhaust ports 22 in fluid communication with the cylinders. The embodiment illustrated in FIGS. 1-3 includes four cylinders 14.1, 14.2, 14.3, 14.4 (collectively 14) having two intake ports 20.1, 20.2 (collectively 20) and two exhaust ports 22.1, 22.2 (collectively 22) associated with each cylinder 14.

An intake manifold 24 is coupled to the cylinder head assembly 16 for supplying combustion gases (in the form of air or an air/fuel mixture) to the intake ports 20 and through the cylinders 14. A set of intake valves (not shown) are supported on the cylinder head assembly 16 and operate to selectively open and close the intake ports 20. A throttle valve 26 is operably coupled to the intake manifold 24 and controls the amount of combustion gases entering the intake manifold 24.

The cylinder head assembly 16 includes a partially integrated exhaust manifold 28 for collecting combustion by-product gases and delivering these exhaust gases to an exhaust system E having a catalytic converter C. As used herein, the term integrated exhaust manifold refers to an integral or monolithic structure forming the body portion 18 of the cylinder head assembly 16 covering the exhaust ports 22 and at least some of the legs 30.1, 30.2. 30.3 (collectively 30) of the exhaust manifold 28. The exhaust manifold 28 is partially integrated in that each leg 30 of the exhaust manifold 28 is separate or independent of the other legs and is further configured to have a separate outlet or exit port 32.1, 32.2, 32.3 (collectively 32) for each leg 30 as compared to terminating at a single outlet for all legs. The cylinder head assembly 16 and partially integrated exhaust manifold 28 described herein can be fabricated using any suitable manufacturing processes known to one of ordinary skill in the art of engine component fabrication.

The length of the first leg 30.1 is substantially shorter than the length of the second leg 30.2 and the length of the third leg 30.3. As presently preferred, the first leg 30.1 is about one-quarter to one-third the length of a leg in a conventional exhaust manifold, and more preferably approaches a length typical of the exhaust passageway formed in a conventional cylinder head. The length of the second leg 30.2 and the length of the third leg 30.3 are substantially equal to the length of the exhaust runners formed in a convention exhaust manifold design. Thus, the length of the second leg 30.2 and the length of the third leg 30.3 are at least three times the length of the first leg 30.1. Isolating the first leg 30.1 from the third leg 30.3 has the additional benefit of substantially simplifying the design of the exhaust manifold 28 by eliminating the cross-over configuration required to join the exhaust passageways for cylinder 20.1 and 20.4 in a convention bifurcated exhaust manifold.

The length of the first leg 30.1 may also be effectively "shortened" by substantially decreasing the delivery volume of the first leg 30.1 relative to the enclosed volume of the second leg 30.2 and the third leg 30.3. The delivery volume is defined as the enclosed volume within a given leg between the exhaust port and the exit port circumscribed by the exhaust passageway formed therein. As presently preferred, the delivery volume of the first leg 30.1 is substantially smaller that the delivery volume of the second leg 30.2 and the delivery volume of the third leg 30.3. More preferably the delivery volume of the second leg 30.2 and the delivery volume of the third leg 30.3 are at least three times the delivery volume of the first leg 30.2.

The first leg 30.1 terminates at an end 34 opposite the body portion 18. Flange 36 is formed on end 34 and has an exit port 32.1 formed therethrough. In one embodiment, an exhaust gas control valve 38 is coupled to the flange 36. The shorter length of the first leg 30.1 allows for increased packaging room for any valving that is required to control the direction and destination of the exhaust flow from cylinder 14.1 through intake ports 20. As noted above, the shorter length of the first leg 30.1 significantly reduces the volume of exhaust gas between the exhaust ports 22 of cylinder 14.1 and the control valve 38 (i.e., the EGR delivery volume), thereby substantially improving the response time for exhaust gas recirculation.

An inlet 40 of the control valve 38 is in fluid communication with the first leg 30.1. One outlet 42 of the control valve 38 is in fluid communication with intake ports 22 via an EGR valve 39 and enables dedicated exhaust gas recirculation from the exhaust side of one cylinder 14.1 to the intake side of all cylinders 14. Another outlet 44 of the control valve 38 joins is coupled to the exhaust system E upstream of a catalytic converter C. In operation, the control valve 38 selectively establishes fluid communication for the exit port 32.1 and the EGR valve 39 or the catalytic converter C therefor bypassing the inlet system. In practice, the control valve 38 may be used during an engine startup sequence for controlling exhaust gas recirculation and for decreasing catalytic converter warm-up time.

The second and third legs 30.2, 30.3 terminate at ends 46, 50 opposite the body portion 18. Flange portions 48, 52 are formed at ends 46, 50 of second leg 30.2 and third leg 30.2 respectively. Exit ports 32.2, 32.3 are formed through flange portions 48, 52. In the embodiment illustrated in FIGS. 1-3, flange portions 48, 52 form a common mounting surface. A turbocharger 54 may be coupled to the flange portions 48, 52 such that exhaust gases from cylinders 14.2, 14.3 and 14.4 drive the turbocharger 54. In one embodiment, the turbocharger may be a single turbo such that both exit ports 32.2, 32.3 feed into a single scroll of the turbocharger 54, whereas in the case of a dual turbo exit port 32.2 feeds a first scroll and exit port 32.3 feeds a second scroll of the turbocharger 54. The outlet 56 from turbocharger 54 is coupled to a tailpipe which directs the exhaust gases to the catalytic convertor (not shown).

The embodiment illustrated in FIGS. 1-3 show a four-cylinder engine 10 with the partially integrated exhaust manifold 28. The first exhaust leg 30.1 has a pair of ducts 58.1, 58.2 that are manifolded into a single exhaust passageway 60 for cylinder 14.1 that terminates at exit port 32.1. The second exhaust leg 30.2 has a pair of ducts 62.1, 62.2 that are manifolded into a single exhaust passageway 64 for cylinder 14.2 and a pair of ducts 66.1, 66.2 that are manifolded into a single exhaust passageway 68 for cylinder 14.3. Exhaust passageways 64 and 68 are manifolded together at exit port 32.2. The third exhaust leg 30.3 has a pair of ducts 70.1, 70.2 that are manifolded into a single exhaust passageway 72 for cylinder 14.4 that terminates at exit port 32.3.

Figure 4:
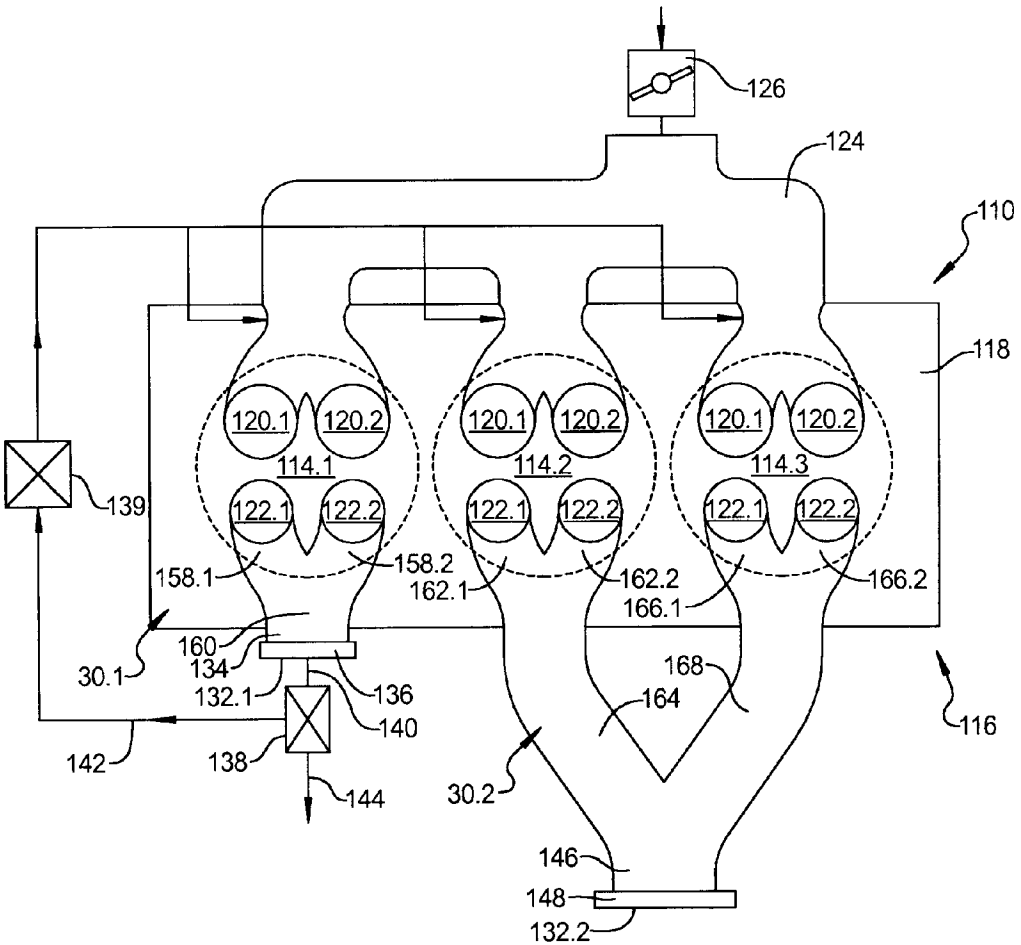
FIG. 4 is a schematic top view similar to FIG. 1 showing the partially integrated exhaust manifold in a three-cylinder configuration.

The embodiment illustrated in FIG. 4 shows a three-cylinder configuration 110 with the partially integrated exhaust manifold 128. The first exhaust leg 130.1 has a pair of ducts 158.1, 158.2 that are manifolded into a single exhaust passageway 160 for cylinder 114.1 that terminates at exit port 132.1. An inlet 140 of the control valve 138 is in fluid communication with the first leg 130.1. One outlet 142 of the control valve 138 is in fluid communication with intake ports 122 via the EGR valve 139 and enables dedicated exhaust gas recirculation from the exhaust side of one cylinder 114.1 to the intake side of all four cylinders 114.1-114.4. Another outlet 144 of the control valve 138 is coupled to the exhaust system upstream of a catalytic converter (not shown).

The second exhaust leg 130.2 has a pair of ducts 162.1, 162.2 that are manifolded into a single exhaust passageway 164 for cylinder 114.2 and a pair of ducts 166.1, 166.2 that are manifolded into a single exhaust passageway 168 for cylinder 114.3. Exhaust passageways 164 and 168 are manifolded together at exit port 132.2. The partially integrated manifold 128 illustrated in FIG. 4 could be used for an inline three-cylinder engine or alternately for each bank of cylinders in a V-6 engine configuration.

Figure 5:
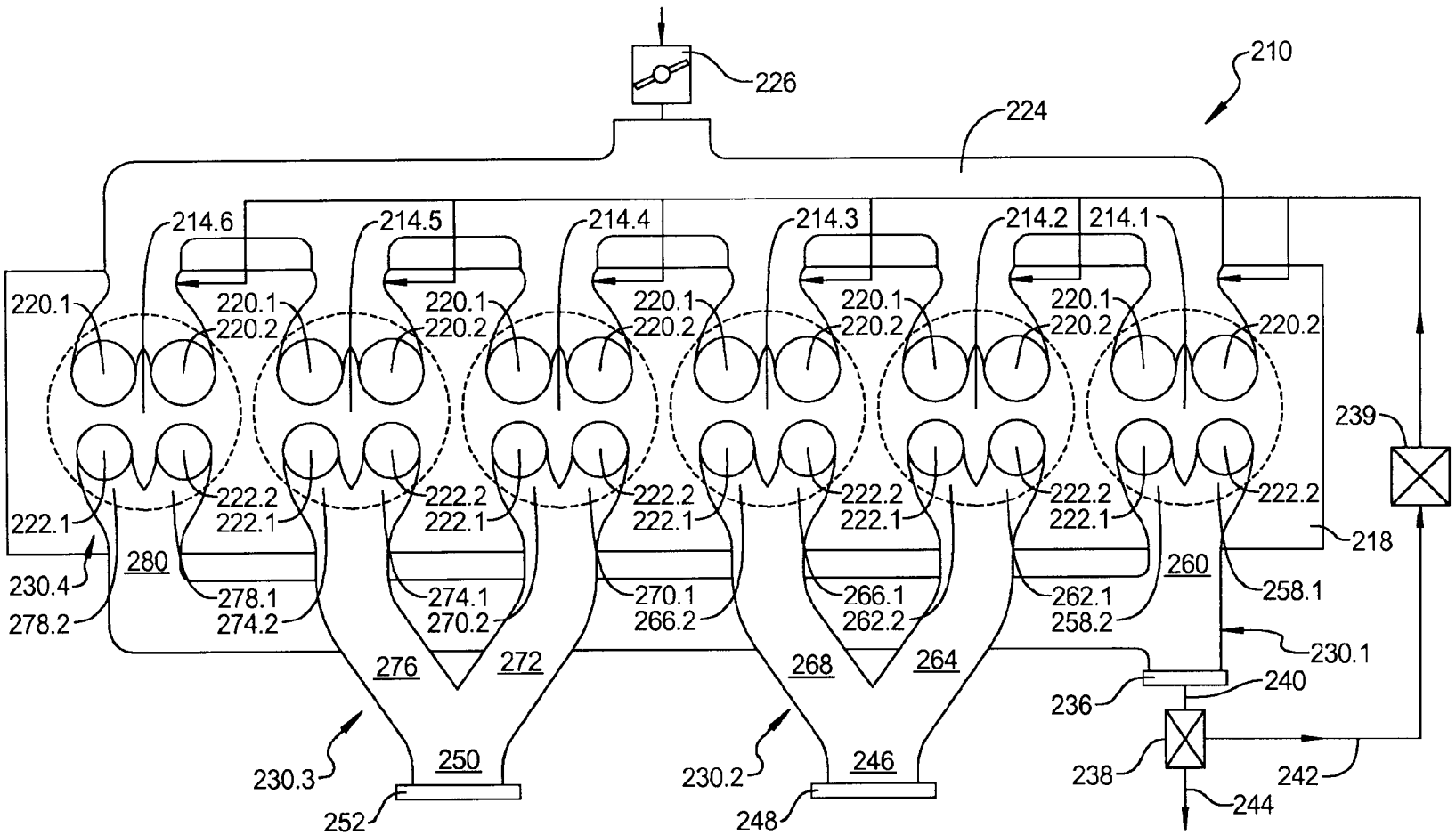
FIG. 5 is a schematic top view similar to FIG. 1 showing the partially integrated exhaust manifold in an in-line six-cylinder configuration.

The embodiment illustrated in FIG. 5 show an inline six-cylinder engine 210 with the partially integrated exhaust manifold 228. The first exhaust leg 230.1 has a pair of ducts 258.1, 258.2 that are manifolded into a single exhaust passageway 260 for cylinder 214.1 that terminates at exit port 232.1. The second exhaust leg 230.2 has a pair of ducts 266.1, 266.2 that are manifolded into a single exhaust passageway 268 for cylinder 114.2 and a pair of ducts 270.1, 270.2 that are manifolded into a single exhaust passageway 272 for cylinder 214.3. Exhaust passageways 268 and 272 are manifolded together at exit port 232.2. The third exhaust leg 230.3 has a pair of ducts 270.1, 270.2 that are manifolded into a single exhaust passageway 272 for cylinder 214.4, and a pair of ducts 274.1, 274.2 that are manifolded into a single exhaust passageway 276 for cylinder 214.5. Exhaust passageways 272 and 276 are manifolded together at exit port 232.3. A fourth exhaust leg 230.4 has a pair of ducts 278.1, 278.2 that are manifolded into a single exhaust passageway 280 for cylinder 114.6. Exhaust passageway 280 is manifolded into exhaust passageway 260. An inlet 240 of the control valve 238 is in fluid communication with the exhaust passageway 260. One outlet 242 of the control valve 238 is in fluid communication with intake ports 222 via the EGR valve 239 and enables dedicated exhaust gas recirculation from the exhaust side of two cylinders 214.1, 214.6 to the intake side of all six cylinders 214.1-214.6. Another outlet 244 of the control valve 238 is coupled to the exhaust system upstream of a catalytic converter (not shown).

The foregoing description of embodiments has been provided for purposes of illustration and to aid in an understanding of this disclosure. It is not intended to be exhaustive or to limit the disclosure. Individual elements or features of a particular embodiment are generally not limited to that particular embodiment, but, where applicable, are interchangeable and can be used in a selected embodiment, even if not specifically shown or described in that manner. The same may also be varied in many ways. Such variations are not to be regarded as a departure from the disclosure, and all such modifications are intended to be included within the scope of the disclosure.

What is claimed is:

1. A partially integrated manifold assembly for a multi-cylinder internal combustion engine, comprising:

a cylinder head having a body portion and at least one port corresponding to each cylinder in an engine block; and a manifold portion including:

a first leg coupled to the body portion and having a first passageway formed therethrough to provide fluid communication from a first port formed in said cylinder head to a first exit port formed in a first flange, wherein said first flange is disposed on an end of said first leg opposite said body portion;

a second leg integrally formed with said body portion and separate from said first leg and a second passageway formed therethrough to provide fluid communication from a second port formed in said cylinder head to a second exit port formed in a second flange, wherein said second flange is disposed on an end of said second leg opposite said body portion;

a third leg integrally formed with said body portion but separately formed from said first leg and a third passageway formed therethrough to provide fluid communication from a third port formed in said cylinder head through a third exit port formed in a third flange, wherein said third flange is disposed on an end of said third leg opposite said body portion;

wherein the length of said first leg is substantially shorter than the length of said second leg and substantially shorter than the length of said third leg.

2. The partially integrated manifold assembly of claim 1 wherein the length of said second leg and said third leg is at least three times the length of said first leg.

3. The partially integrated manifold assembly of claim 1 wherein a delivery volume of said first passageway is substantially less than a delivery volume of said second passageway and substantially less than a delivery volume of said third passageway.

4. The partially integrated manifold assembly of claim 3 wherein the delivery volume of said second passageway and the delivery volume of said third passageway is at least three times the delivery volume of said first passageway.

5. The partially integrated manifold assembly of claim 1 wherein said first leg is integrally formed with said body portion but separately formed from said second leg and said third leg.

6. The partially integrated manifold assembly of claim 1 wherein said third leg is interposed between said first leg and said second leg.

7. The partially integrated manifold assembly of claim 6 wherein said third leg comprises a first duct having said third passageway formed therethrough to provide fluid communication from said third port and a second duct having a fourth passageway formed therethrough to provide fluid communication from a fourth port formed in said cylinder head, said second duct joining the first duct upstream of said third exit port.

8. The partially integrated manifold assembly of claim 1 wherein the cylinder head comprises a pair of ports corresponding to each cylinder in an engine block including a first pair of ports, a second pair of ports, and a third pair of ports.

9. The partially integrated manifold assembly of claim 8 wherein said first leg includes a first pair of ducts to provide fluid communication from said first pair of ports to said first passageway, a second pair of ducts to provide fluid communication from said second pair of ports to said second passageway, and a third pair of ducts to provide fluid communication from said third pair of ports to said third passageway.

10. The partially integrated manifold assembly of claim 1 wherein said first flange is adapted to receive a control valve operable to selectively establish fluid communication between such that said first passageway and one of an EGR valve or a catalytic converter.

11. The partially integrated manifold assembly of claim 1 wherein said second and third flanges have a common mounting surface adapted to receive a turbocharger such that said second and third passageways are in fluid communication with a turbocharger scroll.

12. The partially integrated manifold assembly of claim 1 wherein said second and third flanges have a common mounting surface adapted to receive a turbocharger such that said second passageway is in fluid communication with a first turbocharger scroll and said third passageway is in fluid communication with a second turbocharger scroll.

13. A partially integrated manifold assembly for a multi-cylinder internal combustion engine, comprising:

a cylinder head having a body portion adapted to be coupled to an engine block and having at least one port corresponding to each cylinder in the engine block; and a manifold portion including:

a first leg coupled to the body portion and having a first free end opposite said body portion, said first leg having a first passageway formed therethrough to provide fluid communication from a first port formed in said cylinder head to a first exit port formed in said first free end; and a second leg integrally formed with said body portion but separately formed from said first leg and having a second free end disposed on an end thereof opposite the body portion, said second leg having a second passageway formed therethrough to provide fluid communication from a second port formed in said cylinder head to a second exit port formed in said second free end and a third passageway formed through said second leg to provide fluid communication from a third port formed in said cylinder head to a third exit port formed in said second free end;

wherein the length of said first leg is substantially shorter than the length of said second leg.

14. The partially integrated manifold assembly of claim 13 wherein the length of said second leg is at least three times the length of said first leg.

15. The partially integrated manifold assembly of claim 13 wherein a delivery volume of said first passageway is substantially smaller than a delivery volume of said second passageway and substantially smaller than a delivery volume of said third passageway.

16. The partially integrated manifold assembly of claim 15 wherein the delivery volume of said second passageway and the delivery volume of said third passageway is at least three times the delivery volume of said first passageway.

17. The partially integrated manifold assembly of claim 13 wherein said first leg is integrally formed with said body portion but separately formed from said second leg.

18. The partially integrated manifold assembly of claim 13 further comprising a third leg integrally formed with said body portion but separately formed from said second leg and having a third free end disposed opposite the body portion, said third leg having a fourth passageway formed therethrough to provide fluid communication from a fourth port formed in said cylinder head to a fourth exit port formed in said third free end, wherein the length of said first leg is substantially shorter than the length of said third leg.

19. The partially integrated manifold assembly of claim 13 wherein the free end of the first leg includes a flange adapted to receive a control valve operable to selectively establish fluid communication between said first passageway and one of an EGR valve and a catalytic converter.

20. The partially integrated manifold assembly of claim 13 wherein said free end of said second leg includes a flange adapted to receive a turbocharger such that said second and third passageways are in fluid communication with a turbocharger scroll.

* * * * *